United States Patent [19]

Muchisky et al.

[11] Patent Number: 4,919,117

[45] Date of Patent: Apr. 24, 1990

[54] FACIAL AND BODY MASSAGE APPARATUS AND METHOD

[75] Inventors: Thomas P. Muchisky, 26 Westwood Country Club, St. Louis, Mo. 63131; James V. Young, University City, Mo.

[73] Assignee: Thomas P. Muchisky, St. Louis, Mo.

[21] Appl. No.: 313,054

[22] Filed: Feb. 21, 1989

[51] Int. Cl.[5] ..... A61H 7/00

[52] U.S. Cl. ..... 128/62 R; 128/36

[58] Field of Search ..... 128/57, 36, 49, 48, 128/62 R

[56] References Cited

U.S. PATENT DOCUMENTS

| | | | |
|---|---|---|---|
| 3,570,035 | 3/1971 | Barnett | 15/22 R |
| 3,702,487 | 11/1972 | Sung | 15/22 R |
| 4,137,589 | 2/1979 | Sukhraj | 15/28 |

*Primary Examiner*—Edgar S. Burr

*Assistant Examiner*—Tonya Lamb

*Attorney, Agent, or Firm*—Polster, Polster and Lucchesi

[57] ABSTRACT

A facial and body massage apparatus for skin cleansing and exfoliation is disclosed as having an applicator with a handle and a skin cleansing/exfoliation element for contacting the face or body of a user. The skin cleansing/exfoliation element is constructed to rotate about an axis aligned with the handle while also orbiting in a path about the aforementioned rotational axis to re-position the skin cleansing/exfoliation element continuously about the rotational axis during rotation thereof. The method of the present invention includes applying a continuously-rotating skin cleansing/exfoliation element to the facial or body skin of a user, and simultaneously continuously-orbiting same in an orbiting path about the axis of rotation of the skin cleansing/exfoliation element, to provide maximum surface area contact while reducing heat and skin irritation as well as uneven wear of the skin cleansing/exfoliation element.

20 Claims, 2 Drawing Sheets

FACIAL AND BODY MASSAGE APPARATUS AND METHOD

BACKGROUND OF THE INVENTION

The present invention relates to a facial and body massage apparatus and method, and more particularly, to a facial and body cleansing/skin exfoliation apparatus and method.

Therapeutic machines have been developed to loosen and mobilize bronchial secretions in humans; to improved blood circulation and to relax muscles. Prior to the development of such machines, hand massage and hand percussion by trained nurses or therapists would loosen bronchial secretions by the act of striking the back or chest of a patient. In order to avoid bruising and other damage to the patient while providing consistent, reliable and controlled forces to a patient's body, various types of therapeutic machines have been developed to apply vibrating or percussive forces to the body. In addition to the well-known percussion-type and oscilation-type therapeutic machines, there are therapeutic machines which employ a directional massage stroke in which the resulting force is the product of a force perpendicular to the body to loosen congestive materials, and another force component which is parallel to the body in order to mobilize congested material in a selected direction. Examples of the latter type of therapeutic apparatus are disclosed in U.S. Pat. Nos. 4,098,266; 4,102,334 and 4,757,806, which have been invented by one or both inventors of the present invention.

While generally related to the aforementioned therapeutic apparatus, the present invention is primarily directed to facial and body massage apparatus which involves cleansing and/or skin exfoliation to remove grime and dirt clinging to surface of the skin while also removing dead skin cells. This combined treatment both cleanses the skin while also providing light exfoliation, i.e., removal or taking off dead skin cells from the outer skin layer.

Typically, conventional facial and body cleansing-/exfoliation machines use only rotary action, for example, as shown in U.S. Pat. No. 3,932,908 where a portable scrubbing device incorporates a rotary scrubbing brush which is detachably mounted in a handle member that is powered by a flexible cable driven by a motor mounted in a housing unit. Rotary brushing action at one facial location, for example, can produce skin irritation, while building-up skin heat at that location. In addition, uneven wearing occurs on brush bristles or the like which results from a center hot-spot build up that also contributes to the increased skin heat at that location.

The present invention is a new and improved facial and body massage apparatus, specifically directed to skin cleansing/exfoliation, that overcomes all of the aforementioned deficiencies, while providing many new and important features and advantages, as will be discussed in detail below.

SUMMARY OF THE INVENTION

Among the several objects and advantages of the present invention include:

The provision of a new and improved facial and body cleansing/exfoliation apparatus and method which provides combined rotational and orbital action for constant re-positioning or changing of the contact point(s) with the skin;

The provision of the aforementioned apparatus and method which avoids excessive heat build-up, as in the case of rotary action devices where hot-spots are formed on a facial/body brush, for example;

The provision of the aforementioned apparatus and method which provides maximum surface area contact while also reducing heat build-up on the skin surface of a user;

The provision of the aforementioned apparatus and method which provides even-wearing of the cleansing-/exfoliation contact points, i.e., more even-wearing of brush bristles for longer and more effective use;

The provision of the aforementioned apparatus and method which provides effective removal of grime and dirt clinging to the surface of the skin, while also providing light exfoliation of dead skin cells; and The provision of the aforementioned improved apparatus and method which provides a very useful and helpful cleansing/exfoliation of skin surfaces; is simple and easy to operate without a high degree of skill; is durable and long lasting; and is otherwise adapted for the purposes intended.

Briefly stated, the facial and body massage apparatus of the present invention includes a massage applicator having a handle and a massage head, the massage head including a body massage element for contacting the face or body of a user, the body massage element being rotated about an axis aligned with respect to the handle, while also being orbited in a path about its rotational axis to continuously re-position the body massage element about the axis during rotation thereof. The massage head includes a cylindrical member which is rotatably mounted within a cylindrical housing and has a central axis, the body massage element having its axis within the cylindrical member which is eccentrically offset from the central axis of the cylindrical member. The cylindrical member includes an eccentrically-offset recess for receiving a shaft extension of the body massage element which is preferably releasably received within the eccentrically offset recess.

The body massage element comprises a skin cleansing/exfoliation element such as a brush having a series of closely spaced bristles, a resilient and deformable body that conforms to the face or body of a user, or an abrasive body for engaging the face or body of a user.

The massage applicator includes a housing having first and second axially aligned cylindrical housing sections, the first cylindrical housing section receiving the cylindrical member which is rotatably mounted along an axis aligned with the housing sections, the second cylindrical housing section having a bearing rotatably supported therein, a drive shaft extending through the bearing and connected to the cylindrical member for rotatably driving same, power means for rotating the drive shaft, and the cylindrical member including the body massage element which is releasably received within a recess that is eccentrically offset from the axis of the cylindrical member, in order to allow the body massage element to be rotated while being orbited in a path about the axis of the cylindrical member. The first housing section is diametrically larger than the second housing section so as to define a circumferentially extending radially directed shoulder therebetween, a thrust washer mounted between the shoulder and the cylindrical member, and the drive shaft being threadably mounted to the cylindrical member. A second thrust washer is associated with the bearing on an opposite side from the cylindrical member. The drive shaft includes a flexible drive operatively connected to the drive shaft, the cylindrical member includes a spring loaded ball bearing which extends within the eccentrically offset recess for releasably receiving the body massage element.

In addition to the aforementioned apparatus, the present invention provides a method of cleansing while also providing light exfoliation of the facial and body skin of the user including the steps of applying a continuously rotating skin cleansing/exfoliation element to the facial or body skin of a user, and simultaneously continuously orbiting the continuously rotating skin cleansing/exfoliation element in an orbiting path about the axis of rotation of the continuously rotating skin cleansing/exfoliation element, in order to provide constant repositioning of the continuously rotating skin cleansing/exfoliation element for maximum surface area contact while reducing heat and skin irritation and uneven wear of the continuously rotating skin cleansing/exfoliation element.

These and other objects and advantages of the present invention will become apparent from the description of the invention that is to follow.

Corresponding references numerals will be used throughout the various figures of the drawings.

DESCRIPTION OF THE PREFERRED EMBODIMENTS

Figure 1:
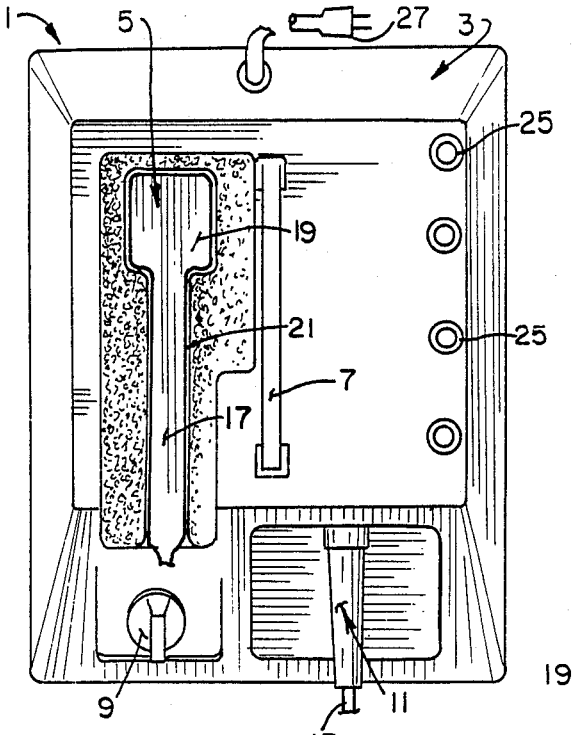
FIG. 1 is a top plan view of the facial and body massage portable power unit including a facial and body massage applicator mounted on the power unit.
Figure 2:
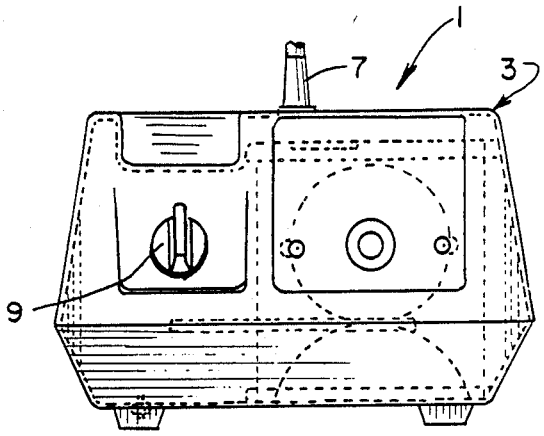
FIG. 2 is an end elevational view of the power unit shown in FIG. 1.

As shown in the drawings, the facial and body massage apparatus generally identified at 1 includes a portable power unit 3 which also acts as mounting assembly for holding a massage applicator 5, as shown in FIG. 1 of the drawings. The portable power unit 3 includes a top handle 7 for portably transporting the power unit 3 to a desired location. The power unit 3 also includes a variable speed electric motor (not shown) operated in a standard fashion by a rotatable control knob 9 for varying the variable speed output through the applicator 5.

In order to understand the conventional manner in which a variable speed electric motor conveys power through a flexible cable connected to a massage applicator, reference is made to applicants U.S. Pat. No. 4,757,806 which discloses a generally operating and interconnected structure for transmitting power between a variable speed electric motor and a massage applicator. While the drive and interconnect structure forms no part per se of the present invention, for purposes of the present description, it is important to note that the coupling assembly 11 attached to the power unit 3, couples the motor drive shaft through a transmission line 13, for operating the applicator 5. Within the transmission line 13 is a flexible drive cable 15 (see FIG. 5) for operating the applicator 5, as will be described.

Figure 3:
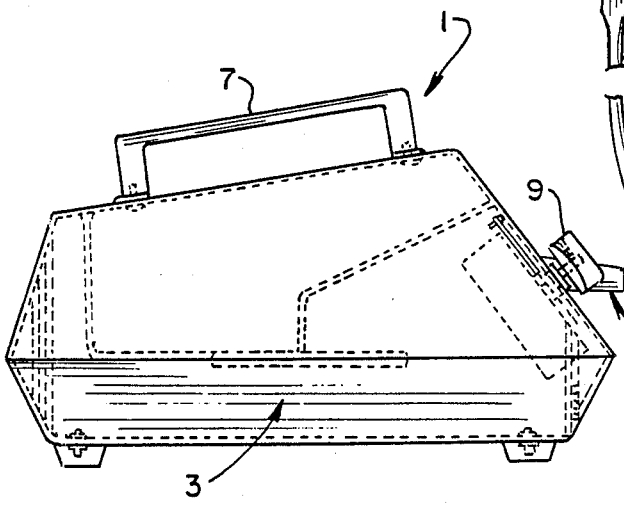
FIG. 3 is a side elevational view of the power unit shown in FIGS. 1–2.
Figure 5:
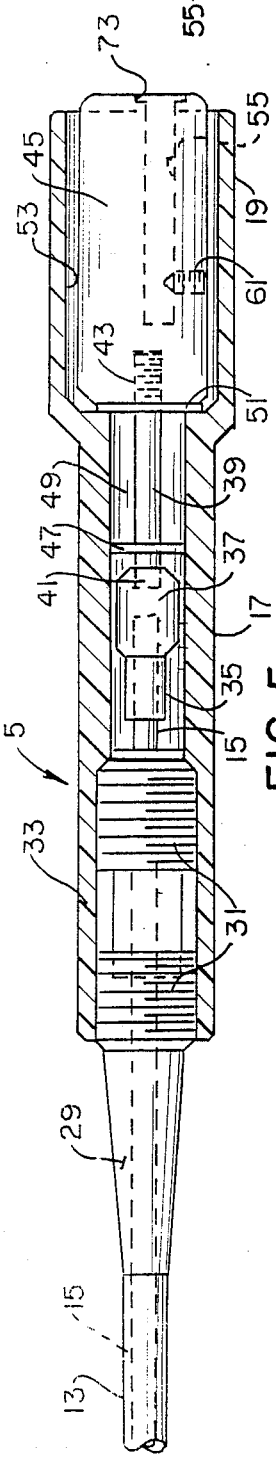
FIG. 5 is a section view of an applicator, shown in actual size, for gripping and operation by a user.

As best seen in FIGS. 1, 3 and 5 of the drawings, the applicator 5 includes a handle 17 for gripping by a user and massage head 19, as shown. Power unit 3 includes a complementary shaped opening 21 formed in an upper area thereof for receiving handle 17 and massage head 19 of the applicator 5, as shown. The actual typical size of the applicator including the integral handle 17 and massage head 19 is illustrated in FIG. 5 of the drawings.

The massage head 19 of the applicator 5 includes a body massage element, such the skin cleansing-exfoliation facial or body brush **23*a*, as shown in FIG. 3 of the drawings. The manner in which the facial or body brush 23*a* is mounted and operated with respect to the applicator 5** will be described in detail below.

Figure 4:
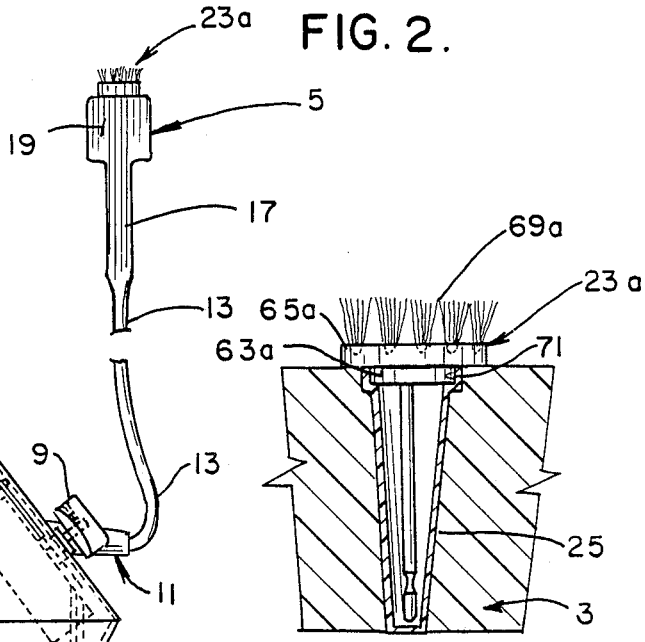
FIG. 4 is a fragmentary sectional view of power unit receptacles or tubes for receiving various types of body massage elements, such as the skin cleansing/exfoliation facial brush illustrated.

It is to be noted that the upper panel of the power unit 3 includes a series of receptacles 25, shown to be four in number in FIG. 1 of the drawings, for receiving various types of skin cleansing/exfoliation elements as will be described in connection with FIGS. 7–10 of the drawings. As shown in FIG. 4 of the drawings, a skin cleansing/exfoliation element in the form of a facial or body brush **23*a* is shown as being mounted with respect to one of the receptacles 25 and received within the confines of the portable power unit 3. While the receptacles 25 may have any desired shape for receiving various types of skin cleansing/exfoliation elements to be described, it will be noted in FIG. 4 of the drawings that the receptacle 25 has a generally frusto-conical shape, with a smaller closed bottom end and a larger open upper end for complementary reception of the facial or body brush element 23*a***, as shown.

When it is desired to operate the facial and body massage apparatus 1, an electrical receptacle plug 27, extending from the power unit 3, is connected to a suitable wall outlet and the applicator 5 is removed from its complementary opening 21 within the power unit 3. Any one of a variety of different types of skin cleansing/exfoliation elements, such as will be described in connection with FIGS. 7–10, may be removed from the receptacles 25 in the power unit 3 for mounting within the massage head 19 of the applicator 5. At this point, the rotatable control knob 9 is turned to select the desired output for driving various types of skin cleansing/exfoliation elements shown in FIGS. 7–10.

Attention is now focused to FIGS. 5–11 of the drawings for a specific description of the apparatus and method of the present invention.

Figure 6:
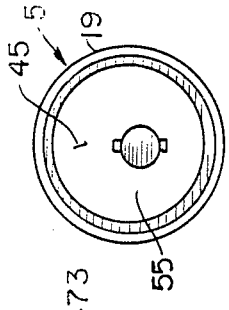
FIG. 6 is an end elevational view of the applicator shown in FIG. 5.
Figure 11:
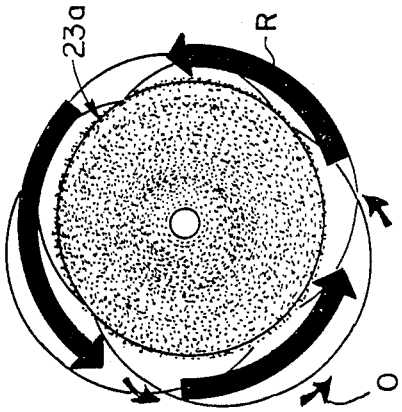
FIG. 11 is an end elevational view of the skin cleansing/exfoliation facial or body brush element shown in FIG. 7 and illustrating the rotational/orbital movement thereof by the schematic arrow representations shown.

FIGS. 5–6 show a specific construction for the applicator 5: FIGS. 7–10 show various types of skin cleansing/exfoliation elements; and FIG. 11 illustrates the rotational and oscilational movement of the facial or body brush element 23*a*, for example, in accordance with the teachings of the present invention.

As shown in FIG. 5 of the drawings, the applicator 5 has a hollow elongated handle 17 and an integral hollow massage head 19. The hollow massage head 19 comprises a larger cylindrical housing section within the elongated hollow generally cylindrically shaped housing section forming the elongated handle 17.

At the rear of the applicator 5, an integrally molded strain relief section 29 interconnects the transmission line 13 with the applicator 5. It will be appreciated that the transmission line 13 and the strain relief section 29 are preferably made from a suitable plastic material, as is well known. The flexible drive cable 13, shown in dotted lines in FIG. 5, extends from the portable through the strain relief section 29 into the applicator 5. The strain relief section 29 is attached to an externally threaded ferrule 31 which is threadably associated relative to the complementary internally threaded tubular end section 33 of the applicator 5. Internally threaded ferrule 31 has a hollow bore therethrough for receiving the flexible drive cable 15, as shown in FIG. 5 of the drawings. Within the applicator handle section 17, the flexible drive shaft 15 is connected to drive shaft ferrule 35 and the flexible drive core 37, in order to connect the flexible drive shaft 15 to a rigid drive shaft 39. Specifically, it will be seen that the drive shaft 39 is connected at one end 41 to the flexible drive core 37, while being threadably connected as at 43 to the cylindrical driven member 45. Drive shaft 39 extends through the thrust washer 47 then through an immediately adjacent hollow bearing insert 49 which is received within the cylindrical bore of the handle section 17. The drive shaft further extends through a second thrust washer 51 which is trapped between the surfaces of the bearing insert 39 and cylindrical member 45. A circumferencial extending radially directed shoulder 53 between the larger massage head cylindrical section 19 and the smaller cylindrically-shaped housing section or handle 17 allows the thrust washer 51 to rest thereon, while being trapped between the end surfaces the bearing insert 49 and the cylindrical member 45. Through the thrust washer 47, the bearing insert 49, the thrust washer 59 and its relationship to the end surfaces of the bearing insert 49 and the cylindrical member 45, the rigid drive shaft 39 is securely and stably supported to enable the cylindrical member 45 to be continuously rotated about an axis generally aligned with the axis of the drive shaft 39.

It will be noted that the cylindrical member 45 is radially or laterally spaced from the inner wall surface 53 of the cylindrically-shaped massage head housing section 19 in order to allow the cylindrical member 45 to be freely rotably driven by the drive shaft 39 about an axis generally aligned with the axis of the drive shaft 39.

It will also be noted that the cylindrical member 45 includes an elongated recess 55 which is eccentrically offset from the central axis of the cylindrical member 45. The eccentrically offset recess 55 is constructed to receive the shaft sections 57*a* through 57*d* which are included as part of the skin cleansing/exfoliation elements 23*a* through 23*d* shown in FIGS. 7–10 of the drawings. Adjacent the free end of each of the shaft sections 57*a* through 57*d* is a circumferencially extending groove 59*a* through 59*d* which is constructed and arranged to cooperate with the spring loaded ball bearing 61 mounted in the cylindrical member 45 and intersecting the eccentrically offset elongated recess 59 adjacent the inner closed end thereof. The spring loaded ball bearing 61 is threadably associated relative to the cylindrical member 45, as illustrated in FIG. 5 of the drawings, and is constructed to releasably retain the various skin cleansing/exfoliation elements 23*a* through 23*d* by releasably engaging the circumferencial groove 59*a* through 59*d* thereof.

When any one of the various skin cleansing/exfoliation elements 23*a* through 23*d* is releasably received within the eccentrically offset elongated recess 55 and releasably held in place by the spring loaded ball bearing 51, the skin cleansing/exfoliation elements 23*a* through 23*d* are capable of being driven in a combined rotational and orbital path. Specifically, the skin cleansing/exfoliation elements 23*a* through 23*d* are rotated about a central axis of the cylindrical member 45, by being releasably received within the eccentrically offset recess 55 of the cylindrical member 55, while at the same time being orbited in a path about the central axis of the cylindrical member 45, to continuously re-position the skin cleansing/exfoliation elements 23*a* through 23*d* about the central axis of the cylindrical member 45 during rotation thereof. Thus, any one of the skin cleansing/exfoliation elements 23*a* through 23*d* may be continuously rotated by the cylindrical member 45 while also being simultaneously continuously orbital in an orbital path, as the result of the eccentrically offset recess 55.

The aforementioned combined rotational/orbital movement of any one of the skin cleansing/exfoliation elements 23*a* through 23*d* provides numerous advantages in a facial and body massage apparatus. Combined rotational and orbital action provides constant re-positioning or changing of the contact points with the skin, while avoiding excessive heat build up which may cause skin irritation. In addition, the combined rotational and orbital action provides maximum surface area contact to effectively remove grime and dirt clinging to the surface of the body skin, while also providing light exfoliation to dead skin cells. Finally, the combined rotational/orbital action provides even wearing of the skin cleansing/exfoliation contact points with any of the skin cleansing/exfoliation elements 23*a* through 23*d*, thus providing more even wearing for longer and more effective use.

While it is difficult to represent the combined rotational and orbital action in the drawings, reference is made to FIG. 11 of the drawings which shows the skin cleansing/exfoliation facial or body brush element 23*a* as it is being rotated (represented by the schematic arrows R) while also being orbited (represented by the schematic arrows O). In the case of the skin cleansing-/exfoliation tubular body brush 23*a*, it will be understood that several hundred bristles will be rotated simutaneously while their contact point with the skin's surface is being constantly repositioned due to the orbital brush 23*a*. As a result, all of the aforementioned advantages are made possible by the operation of the applicator 5, as described in detail above.

Figure 7:
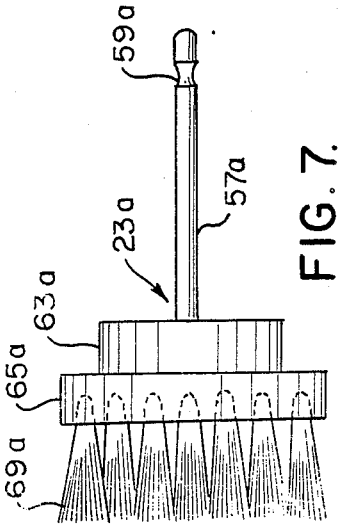
FIG. 7 is a side elevational view of a skin cleansing-/exfoliation facial or body brush used with the applicator shown in FIGS. 5–6.

While there are various types of skin cleansing/exfoliation elements that may be used, FIGS. 7–10 show some of the more conventional types. In FIG. 7 of the drawings, a skin cleansing/exfoliation element 23a includes a smaller cylindrical disc section 63a which is attached one side to the shaft extension 57a and is integrally connected on an opposite side thereof to the larger cylindrical disc 65a which also serves as brush holder for the bristles 69a. A smaller cylindrical disc 63a may be suitably shaped and sized to be received within a complementary opening 71 adjacent the open outer end of the receptacle 25, as shown in FIG. 4, and furthermore may be complementary received within a similar opening 73 in the cylindrical member 45 at the outer open end of the eccentrically offset recess 55, as shown in FIG. 5.

Figure 8:
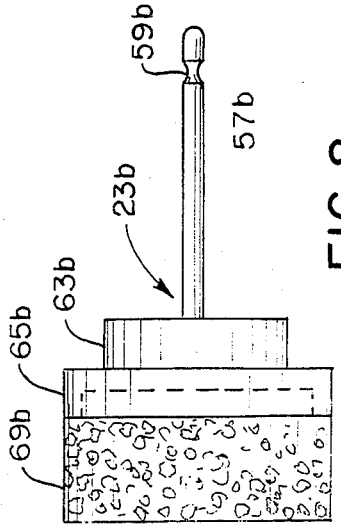
FIG. 8 is a side elevational view of a skin cleansing-/exfoliation element that is resilient and deformable for conforming to the face or body of user.

FIG. 8 shows a skin cleansing/exfoliation element 23b similar to the corresponding element 23a in FIG. 7, with the exception that the portion 69b comprises a flexible foam member which is both resilient and deformable to conform to the face or body of a user.

Figure 9:
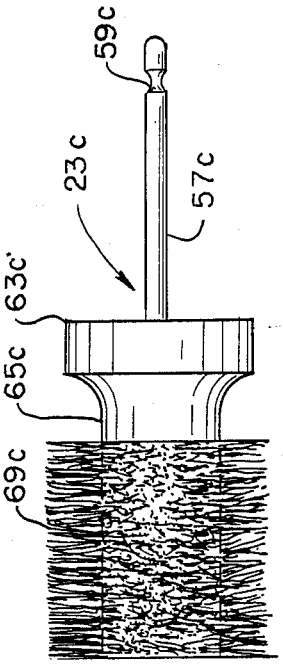
FIG. 9 is a side elevational view of a skin cleansing-/exfoliation body brush element for use with the applicator shown in FIGS. 5–6.

The skin cleansing, exfoliation element 23c shown in FIG. 9 of the drawings show an element 69c mounted to hub shaped section 65c attached to the cylindrical disc 63c. The bristles in the brush member 69c extend radially outwardly rather than being axially connected, as the bristles forming the brush 69a in the FIG. 7 embodiment.

Figure 10:
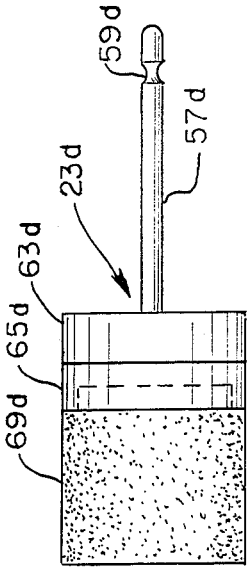
FIG. 10 is a side elevational view of a skin cleansing-/exfoliation pumice stone type massage body element for use with the FIGS. 5–6 applicator.

The skin cleansing/exfoliation element 23d in FIG. 10 of the drawings illustrates a puma stone 69d mounted to the cylindrical disc body 65d, also attached to the cylindrically-shaped dish 63d, as in the previous embodiments. In this instance, the puma stone 69d of the skin cleansing/exfoliation element 23d, may be used to provide the skin treatment that may be desired.

Other and different types of skin cleansing/exfoliation elements, in addition to those shown in FIGS. 7–10 of the drawings, may be employed for the particular purposes desired.

According to the method of the present invention, cleansing and light exfoliation of the facial and body skin of a user may be provided by applying a continuously rotating skin cleansing/exfoliation element to the facial or body skin of the user and simultaneously continuously orbital the continuously rotating skin cleansing/exfoliation element in an orbital path about the axis of rotation of the continuously rotating skin cleansing/exfoliation element, in order to provide constant repositioning of the continuously rotating skin cleansing/exfoliation element for maximum surface area contact, while reducing heat and skin irritation, as well as uneven wear of the continuously rotating skin cleansing/exfoliation element.

In view of the above, it will be seen that the several objects of the invention are achieved and other advantageous results are obtained.

As various changes could be made in the above constructions and method without departing from the scope of the invention, it is intended that all matter contained in the above description or shown in the accompanying drawings shall be interpreted as illustrative and not in a limiting sense.

We claim:

1. A facial and body massage apparatus for skin cleansing/exfoliation comprising:

a massage applicator having a handle and a massage head;

said massage head including a body massage element for contacting the face or body of a user;

means for rotating said body massage element about an axis aligned with said handle and also for simultaneously orbiting said element in a path about said axis to continuously re-position said body massage element about said axis during rotation thereof.

2. The apparatus as defined in claim 1 wherein said massage head includes an cylindrical member rotatably mounted within a cylindrical housing and having a central axis, said body massage element having its axis within said cylindrical member and being eccentrically offset from the central axis of said cylindrical member.

3. The apparatus as defined in claim 2 wherein said cylindrical member includes an eccentrically offset recess for receiving a shaft extension of said body massage element.

4. The apparatus as defined in claim 3 wherein the shaft extension of said body massage element is releasably received within said eccentrically offset recess.

5. The apparatus as defined in claim 4 wherein said body massage element comprises a skin cleansing/exfoliation element.

6. The apparatus as defined in claim 5 wherein said skin cleansing/exfoliation element includes a brush having a series of closely spaced bristles extending therefrom.

7. The apparatus as defined in claim 5 wherein said skin cleansing/exfoliation element includes a resilient and deformable body that conforms to the face or body of a user.

8. The apparatus as defined in claim 5 wherein said skin cleansing/exfoliation element includes an abrasive body for engaging the face or body.

9. The apparatus as defined in claim 2 wherein said housing includes first and second axially aligned cylindrical housing sections which are also axially offset from one another, said first housing section being diametrically larger than said second housing section and receiving the cylindrical member of said massage head therein, a bearing insert mounted within said second smaller cylindrical housing section, a drive shaft extending through said bearing insert and connected to said cylindrical member for rotating same, and means for rotating said drive shaft.

10. A facial and body massage apparatus for skin cleansing/exfoliation comprising:

a massage applicator including a housing having first and second axially aligned cylindrical housing sections, said first cylindrical housing section receiving a cylindrical member which is rotatably mounted along an axis aligned with said housing sections;

said second cylindrical housing section having a bearing insert supported therein, a body massage element, means for rotating said element about the axis and also simultaneously orbiting said element in a path about the axis, said means including a drive shaft extending through said bearing insert and connected to said cylindrical member for rotatably driving same;

power means for rotating said drive shaft; and a recess eccentrically offset in said cylindrical member for releasably receiving said body massage element from the axis of said cylindrical member.

11. The apparatus as defined in claim 10 wherein said first housing section is diametrically larger than said second housing section defining a circumferentially extending radially directed shoulder therebetween, a thrust washer between said shoulder and said cylindrical member, and said drive shaft being threadably mounted to said cylindrical member.

12. The apparatus as defined in claim 11 and including a second thrust washer associated with said bearing insert which is on an opposite side from said cylindrical member.

13. The apparatus as defined in claim 12 wherein said drive shaft includes a flexible drive operatively connected to said drive shaft.

14. The apparatus as defined in claim 13 wherein said cylindrical member includes a spring loaded ball bearing which extends within said eccentrically offset recess for releasably receiving said body massage element.

15. A method of cleansing while also providing light exfoliation of the facial and body skin of a user, comprising the steps of:

applying a continuously rotating skin cleansing/exfoliation element to the facial or body skin of a user; and simultaneously continuously orbiting said continuously rotating skin cleansing/exfoliation element in an orbiting path about the axis of rotation of said continuously rotating skin cleansing/exfoliation element, whereby to provide constant repositioning of said continuously rotating skin cleansing/exfoliation element for maximum surface area contact while reducing heat and skin irritation as well as uneven wear of said continuously rotating skin cleansing/exfoliation element.

16. The method as defined in claim 15 including the step of applying a continuously rotating closely spaced series of individual brush bristles to further minimize heat build-up during operation of said method.

17. The method as defined in claim 15 including the step of applying different types of skin cleansing/exfoliation elements to achieve the cleansing/exfoliation desired.

18. In a facial and body skin cleansing/exfoliation apparatus including an applicator having a handle and a skin cleansing/exfoliation element for contacting the face or body of a user, the improvement comprising means for rotating said skin cleansing/exfoliation element about an axis aligned with said handle and also simultaneously orbiting said skin cleansing/exfoliation element in a path about said axis to continuously reposition said skin cleansing/exfoliation element about said axis during rotation thereof.

19. The improvement as defined in claim 18 wherein said means includes a cylindrical member rotatably received within a housing having an eccentrically offset recess which releasably receives said skin cleansing/exfoliation element.

20. The improvement as defined in claim 19 wherein said housing includes first and second housing sections, said cylindrical member being rotatably mounted within said first housing section and a bearing insert supported by said second housing section and having a drive shaft therethrough for rotatably driving said cylindrical member.

* * * * *